US007263198B2

(12) United States Patent
Onuma

(10) Patent No.: US 7,263,198 B2
(45) Date of Patent: Aug. 28, 2007

(54) LOUDSPEAKER

(75) Inventor: Tetsuya Onuma, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 426 days.

(21) Appl. No.: 10/806,888

(22) Filed: Mar. 22, 2004

(65) Prior Publication Data

US 2004/0197007 A1 Oct. 7, 2004

(30) Foreign Application Priority Data

Apr. 7, 2003 (JP) ..... P2003-102752

(51) Int. Cl.
*H04R 25/00* (2006.01)

(52) U.S. Cl. ..... 381/403; 381/432; 381/433

(58) Field of Classification Search ..... 381/396, 381/400, 403, 407, 398, 404, 405, 412, 414, 381/416, 420, 423, 432, 433; 181/154, 157, 181/161–164, 166, 171–173
See application file for complete search history.

(56) References Cited

U.S. PATENT DOCUMENTS

| | | | | |
|---|---|---|---|---|
| 3,176,086 | A * | 3/1965 | Coen | 381/433 |
| 4,061,890 | A * | 12/1977 | Froeschle | 381/410 |
| 4,158,756 | A | 6/1979 | Keezer | 381/433 |
| 4,465,905 | A * | 8/1984 | Nation | 381/386 |
| 4,565,905 | A * | 1/1986 | Nation | 381/186 |
| 6,474,440 | B2 * | 11/2002 | Kato | 181/161 |
| 6,618,487 | B1 * | 9/2003 | Azima et al. | 381/152 |
| 6,672,423 | B2 * | 1/2004 | Kato | 181/161 |
| 6,842,529 | B2 * | 1/2005 | Koura et al. | 381/403 |
| 7,079,665 | B2 * | 7/2006 | Shimomura et al. | 381/433 |
| 2001/0004954 | A1 * | 6/2001 | Kato | 181/173 |
| 2002/0017423 | A1 * | 2/2002 | Kato | 181/161 |
| 2002/0044671 | A1 * | 4/2002 | Shimomura et al. | 381/386 |

FOREIGN PATENT DOCUMENTS

| | | |
|---|---|---|
| EP | 1 178 703 A2 | 6/1979 |
| GB | 2 119 202 A | 11/1983 |
| JP | 2002-051394 | 2/2002 |
| JP | 2002-271893 | 9/2002 |

* cited by examiner

*Primary Examiner*—Huyen Le
(74) *Attorney, Agent, or Firm*—Ladas & Parry LLP

(57) ABSTRACT

A loudspeaker comprises a frame, a magnetic circuit unit, a vibration unit and a snap fastening device. The frame has a recess. The magnetic circuit unit is received in the recess of the frame. The magnetic circuit unit includes a yoke. The vibration unit is received in the recess of the frame. The snap fastening device connects the yoke, which is inserted into the recess of the frame, to the frame.

18 Claims, 6 Drawing Sheets

LOUDSPEAKER

BACKGROUND OF THE INVENTION

1. Field of the Invention

The present invention relates to a loudspeaker.

2. Related Art

In the conventional loudspeaker, when a magnetic circuit unit is received in a recess of a frame, together with a vibration unit, a yoke of the magnetic circuit unit is fixed to the frame by calking, welding or bonding through an adhesive, as described in Japanese Laid-Open Patent Application No. 2002-51394 and Japanese Laid-Open Patent Application No. 2002-271893.

In such a conventional loudspeaker, a cone and a damper of the vibration unit are connected to a voice coil bobbin through a connection member, which is placed so as to cover the yoke of the magnetic circuit unit. The cone, the damper and the voice coil bobbin are fixed to the connection member through an adhesive.

However, the structure in which the yoke is fixed to the frame by calking, etc. as in the prior art, causes inconveniences that the fixing operation is complicated and time-consuming and a misalignment between these components may easily occur.

In addition, the structure in which the damper and the voice coil bobbin are fixed to the connection member through an adhesive causes inconveniences that the adhered components may easily be peeled off.

SUMMARY OF THE INVENTION

An object of the present invention, which was made to solve the above-described problems, is therefore to provide a loudspeaker, which makes it possible to provide an easy assembling operation, avoid a misalignment of components and prevent the assembled components from being come off.

In order to attain the aforementioned object, a loudspeaker according to one of aspects of the present invention comprises:

a frame having a recess;

a magnetic circuit unit received in the recess of the frame, the magnetic circuit unit comprising a yoke;

a vibration unit received in the recess of the frame said vibration unit comprising a damper, a cone, a voice coil bobbin and a connection member by which said damper, said cone and the voice coil bobbin are combined together, said connection member having on an outer side thereof an annular groove in which an inner peripheral edge of the damper is received, and the inner peripheral edge of the damper being secured in the annular groove; and a fastening device for connecting the yoke, which is inserted into the recess of the frame, to the frame.

According to another aspect of the present invention, the fastening device may comprise male members and female members with which the male members are to be engaged, the male members being formed on any one of the frame and the yoke along a circle, which is concentric with a central axis thereof, and the female members being formed on an other of the frame and the yoke, the male members and the female members being engaged with each other by bringing the yoke into contact with the frame and turning the yoke along the circle.

According to further another aspect of the present invention, there may be adopted a structure in which the yoke has a cylindrical member; and the connection member having on an inner side thereof a ring-shaped recess into which the cylindrical member of the yoke is to be received.

According to further another aspect of the present invention, the connection member may have a skirt portion, which comes into contact with the damper and the cone, the skirt portion having a plurality of ribs.

According to further another aspect of the present invention, the connection member may be provided at its portion, which comes into contact with the voice coil bobbin, with an inclined surface, which extends toward a rear side of the frame, the inclined surface having a plurality of grooves.

According to further another aspect of the present invention, the connection member may be provided at its portion, which comes into contact with the damper, with a ring-shaped groove, which opens toward a front side of the frame.

According to further another aspect of the present invention, there may be adopted a structure in which the damper has an inner peripheral edge coming into contact with the connection member, the inner peripheral edge having a bent portion, which projects toward the front side of the frame; and the cone has an inner peripheral edge, the inner peripheral edge of the cone having a bent portion, which projects toward the rear side of the frame, so as to surround the inner peripheral edge of the damper.

DESCRIPTION OF THE PREFERRED EMBODIMENTS

Now, embodiments of a loudspeaker of the present invention will be described in detail below with reference to the accompanying drawings.

First Embodiment

Figure 1:
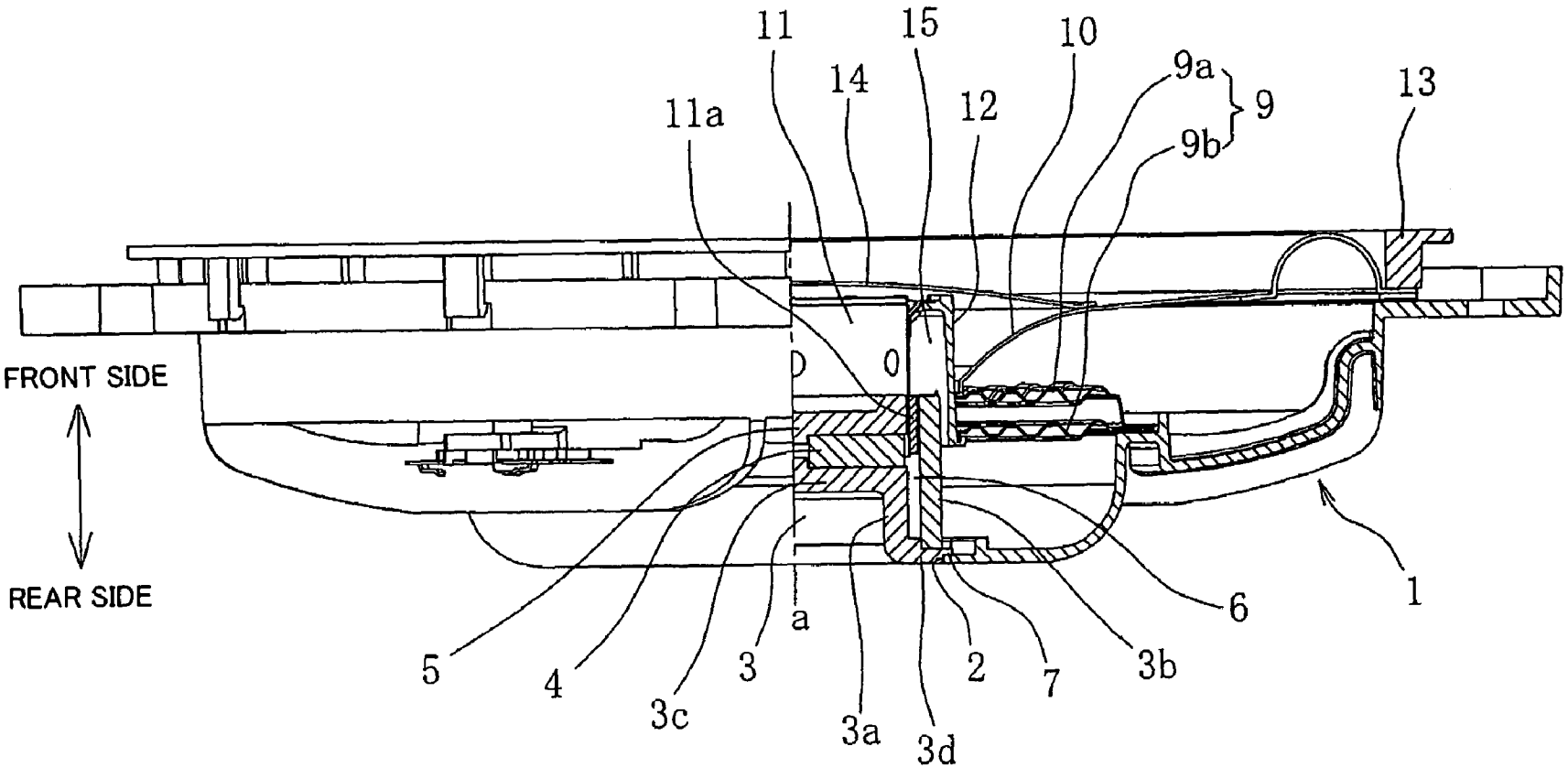
FIG. 1 is a side view having a partially sectioned portion, illustrating a loudspeaker according to the first embodiment of the present invention.
Figure 2:
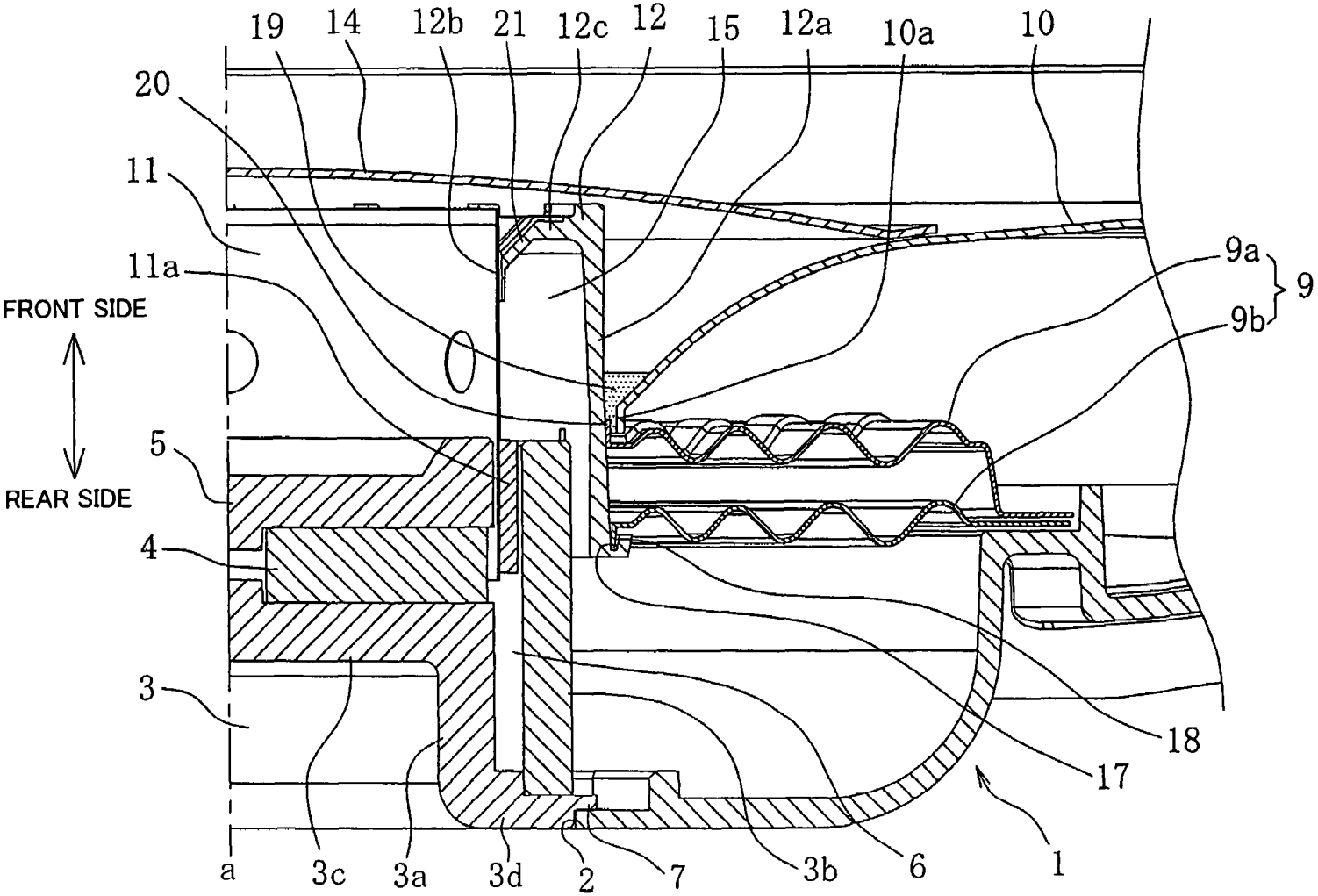
FIG. 2 is an enlarged view of essential components as shown in FIG. 1.
Figure 3:
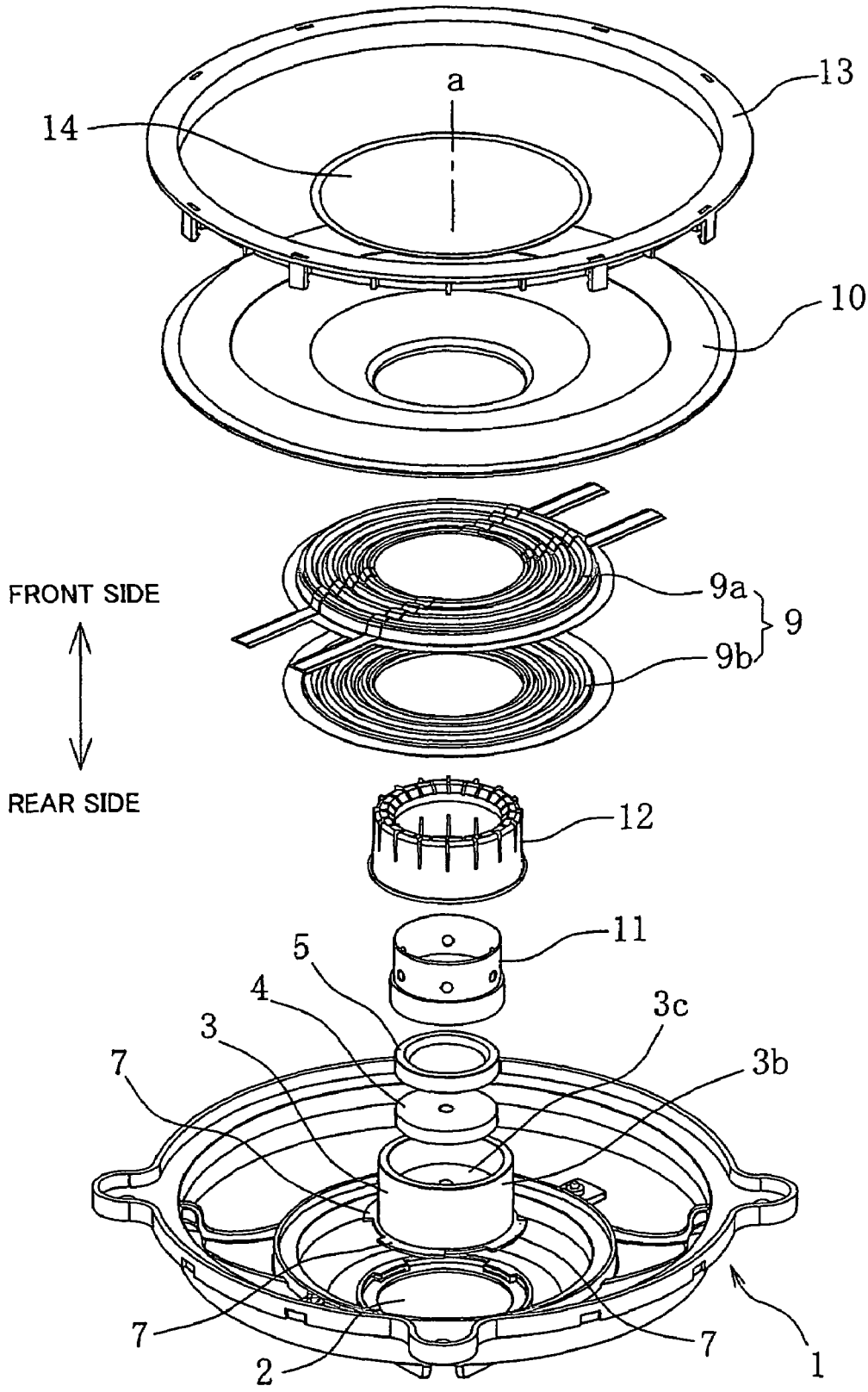
FIG. 3 is an exploded perspective view of the loudspeaker as shown in FIG. 1.

The loudspeaker includes a frame 1, a magnetic circuit unit and a vibration unit. The frame 1 has a recess in which the magnetic circuit unit and the vibration unit are received, as shown in FIGS. 1 to 3.

The frame 1, which generally has a bowl-shape, is provided at its bottom with a fitting hole 2 into which the magnetic circuit unit is to be fitted and secured. The fitting hole 2 is concentric with a central axis "a" of the frame 1. The frame 1 is formed of plastic material for reduction in weight. The frame 1 may however be formed of another material such as metal.

The magnetic circuit unit includes components such as a yoke 3, a magnet 4 and a plate 5. The yoke 3, the magnet 4 and the plate 5 are placed one upon another in this order from the rear side of the frame 1 toward the front side thereof, i.e., from the bottom of the recess of the frame 1 toward the upper side, so as to be concentric with the central axis "a" of the frame 1, and secured to the frame 1. Such a structure in which the magnetic circuit unit including the yoke 3 is received in the recess of the frame 1, makes it possible to reduce generally the thickness of the loudspeaker.

The yoke 3 is provided with a double wall structure, i.e., inner and outer cylindrical members 3*a*, 3*b*, and an end plate 3*c* by which the upper end opening of the inner cylindrical member 3*a* is closed, as shown in FIGS. 1 to 4. The inner cylindrical member 3*a* has a ring-shaped bottom plate 3*d*, to which the outer cylindrical member 3*b* is joined. The magnet 4 and the plate 5, both of which have a disc-shape, are placed on the end plate 3*c* in a piled state and fixed thereto. The inner cylindrical member 3*a* of the yoke 3, and the outer peripheral surfaces of the magnet 4 and the plate 5 face the inner peripheral surface of the outer cylindrical member 3*b* of the yoke 3 through an annular gap 6. A magnetic path is formed between the outer cylindrical member 3*b* and a set of the inner cylindrical member 3*a* of the yoke 3, the magnet 4 and the plate 5 in this manner.

The bottom plate 3*d* of the yoke 3 is provided so as to be fitted into the fitting hole 2 of the frame 1, as shown in FIG. 2. Such a structure, in which the yoke 3 is fitted into the fitting hole 2 of the frame 1, makes it possible to reduce the thickness of the loudspeaker. The above-mentioned fitting hole 2 may be omitted, as an occasion demands.

Figure 4:
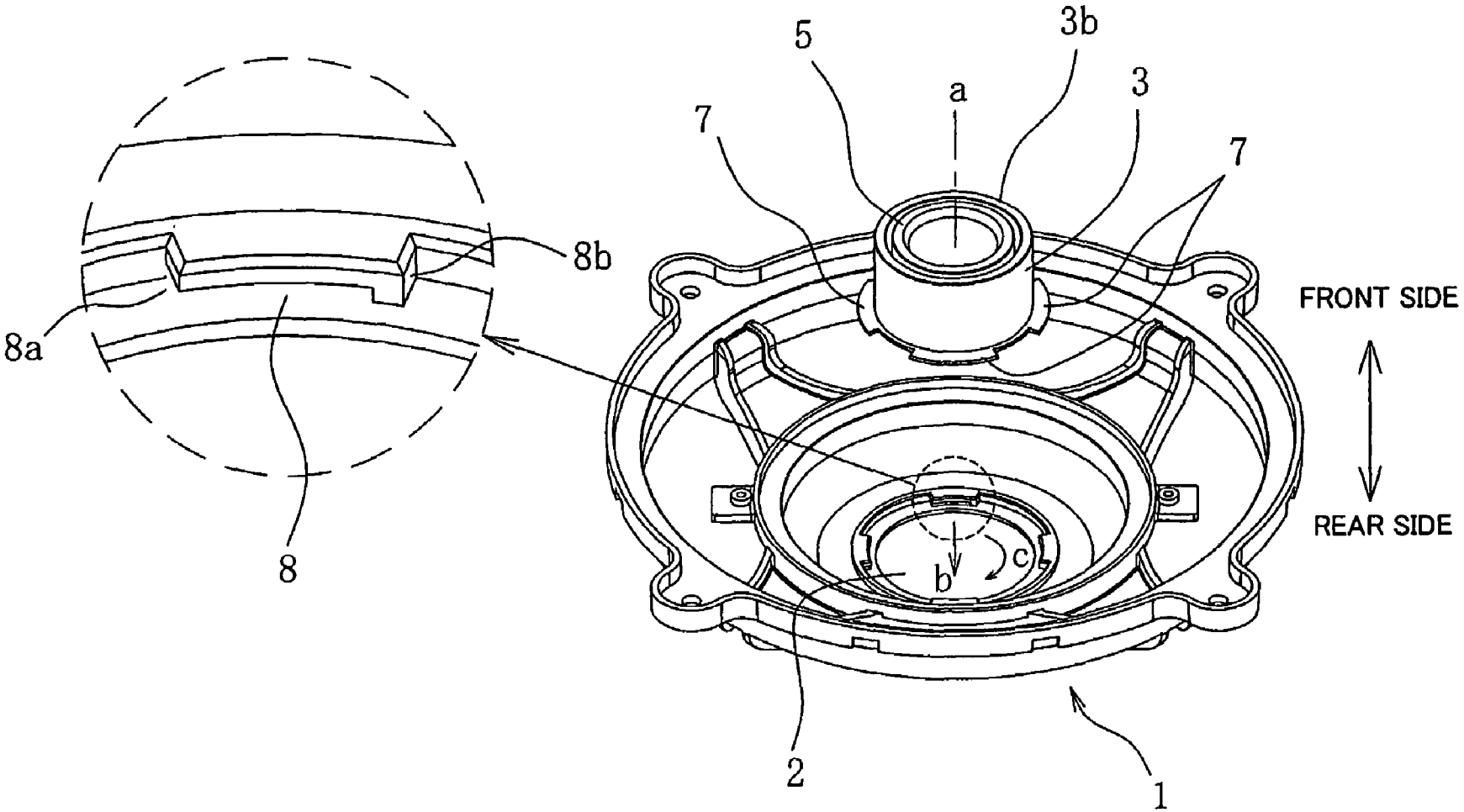
FIG. 4 is an exploded perspective view of a frame and a yoke as shown in FIG. 1.

A fastening device is provided, as shown in FIG. 4, between the outer periphery of the bottom plate 3*d* of the yoke 3 and the inner periphery of the fitting hole 2 of the frame 1 so that the yoke 3 is inserted into the recess of the frame 1 from the front side thereof and the bottom plate 3*d* of the yoke 3 engages with the bottom of the recess of the frame 1 to provide a stationary, secured state. Use of the fastening device enables the yoke 3 to be secured easily and quickly on the frame 1 by a one-touch operation. It is possible to make an easy and accurate positional determination of the yoke 3 relative to the recess of the frame 1 and hold the yoke 3 stationary in its proper position, even though it is difficult for an operator to visually recognize the bottom of the recess of the frame 1.

The fastening device is preferably has male members, which are provided on the bottom of the yoke 3, and female members, which are provided on the bottom of the recess of the frame 1. The male and female members are aligned on a circle, which is concentric with the central axis "a" of the frame 1. As shown in FIGS. 1 to 4, the male members are provided in the form of a plurality of projection pieces 7, which radially project from the outer periphery of the bottom plate 3*d* of the yoke 3 so as to be spaced uniformly, and the female members are provided in the form of grooves 8, which are formed on the inner periphery of the fitting hole 2 of the frame 1 so that the above-mentioned projection pieces 7 are fitted into the grooves 8. Each of the grooves 8 formed along the circle has an opening 8*a* on the upstream end side in a circumferential direction, on the one hand, and a stopper 8*b* is provided on the downstream side of each of the grooves 8 in the circumferential direction, on the other hand. According to such a structure, when the yoke 3 is inserted from its bottom side into the recess of the frame 1 in a direction of an arrow "b" as shown in FIG. 4, and then, the yoke 3 is turned around the central axis "a " of the frame 1 in a direction of an arrow "c" so that the projection pieces 7 are inserted into the grooves 8, these projection pieces 7 come into contact with the stoppers 8*b*, with the result the yoke 3 is kept in its properly secured state. Engagement of the male and female members is completed in this manner so as to make a proper positional determination of the yoke 3 relative to the frame 1 and hold it in such a state.

The structures of the male and female members are not limited only to the above-described projection pieces 7 and grooves 8, respectively, which enable them to be engaged with each other by bringing the yoke 3 into contact with the frame 1 and turning the yoke 3 in the circumferential direction relative to the frame 1. More specifically, there may be adopted, for example, a structure in which the male member is provided in the form of a inwardly extending rim, which is formed on the frame 1, on the one hand, and the female member is provided in the form of an outwardly extending rim, which is formed on the yoke 3 so that the outside diameter of the outwardly extending rim of the yoke 3 is slightly larger than the inside diameter of the inwardly extending rim of the frame 1, on the other hand. In this case, at least one of these extending rims must be elastically deformable. Such a structure enable the outwardly extending rim of the yoke 3 and the inwardly extending rim of the frame 1 to be engaged with each other only by pushing the yoke 3 against the frame 1 in the direction of the central axis "a" of the frame 1. Such a pushing operation causes at least one of the outwardly extending rim of the yoke 3 and the inwardly extending rim of the frame 1 to be deformed elastically so that the outwardly extending rim of the yoke 3 engages with the inwardly extending rim of the frame 1 through a snap action. As a result, the yoke 3 is stationarily secured on the frame 1. The outwardly extending rim and the inwardly extending rim may be provided in the form of rim-pieces, which are aligned on a circle. Alternatively, any one of the above-described outwardly extending rim and inwardly extending rim may be provided in the form of an annular groove so that the other of them can be elastically deformed and received in the annular groove.

The vibration unit includes components such as a damper 9, a cone 10, a voice coil bobbin 11 and a connection member 12, as shown in FIGS. 1 to 3.

As shown in FIG. 2, the damper 9, which supports the other portions of the vibration unit on the frame 1, preferably has a dual layer structure in which the first and second damping members 9*a*, 9*b* are combined together. The outer peripheral edge of the first damping member 9*a* is placed on the outer peripheral edge of the second damping member 9*b*, and then these peripheral edges are fixed to the frame 1 at a middle position of the recess thereof by an adhesive. The inner peripheral edge of the first damping member 9*a* and the inner peripheral edge of the second damping member 9*b* are separated from each other and fixed to the connection member 12 by an adhesive. The first and second damping members 9*a*, 9*b* may be substituted by a single damping member. Alternatively, the first and second damping member 9*a*, 9*b* may be substituted by three or more damping members.

As shown in FIGS. 1 and 2, the cone 10 is placed on the inlet side of the recess of the frame 1. The inner peripheral edge of the cone 10 is connected to the connection member 12 by an adhesive 19, together with the inner peripheral edge of the first damping member 9*a* serving as the upper layer. The outer peripheral edge of the cone 10 is fixed to the frame 1 along the outer periphery of the recess thereof by means of a gasket 13 as shown in FIGS. 1 and 3. A cap 14 closes the central portion of the cone 10.

As shown in FIG. 2, the voice coil bobbin 11 is a cylindrical member, which is to be inserted into the annular gap 6 in the yoke 3 of the magnetic circuit unit. A voice coil 11*a* is disposed below the above-described cylindrical member, which is inserted into the annular gap 6. Supply of electric signals to the voice coil 11*a* causes the voice coil bobbin 11 to vibrate in the central axis "a" of the frame 1 under the function of the magnetic path provided in the annular gap 6 of the yoke 3.

The connection member 12, which connects the damper 9, the cone 10 and the voice coil bobbin 11 to each other as shown in FIG. 2, is provided with a ring-shaped recess 15 into which the cylindrical member, i.e., the outer cylindrical member 3*b* of the yoke 3 is to be inserted. Vibration of the voice coil bobbin 11 to make a reciprocating motion in the annular gap 6 of the yoke 3 in the direction of the central axis "a" of the frame 1 causes the outer cylindrical member 3*b* of the yoke 3 to make a reciprocating motion in the ring-shaped recess 15 of the connection member 12.

Figure 5:
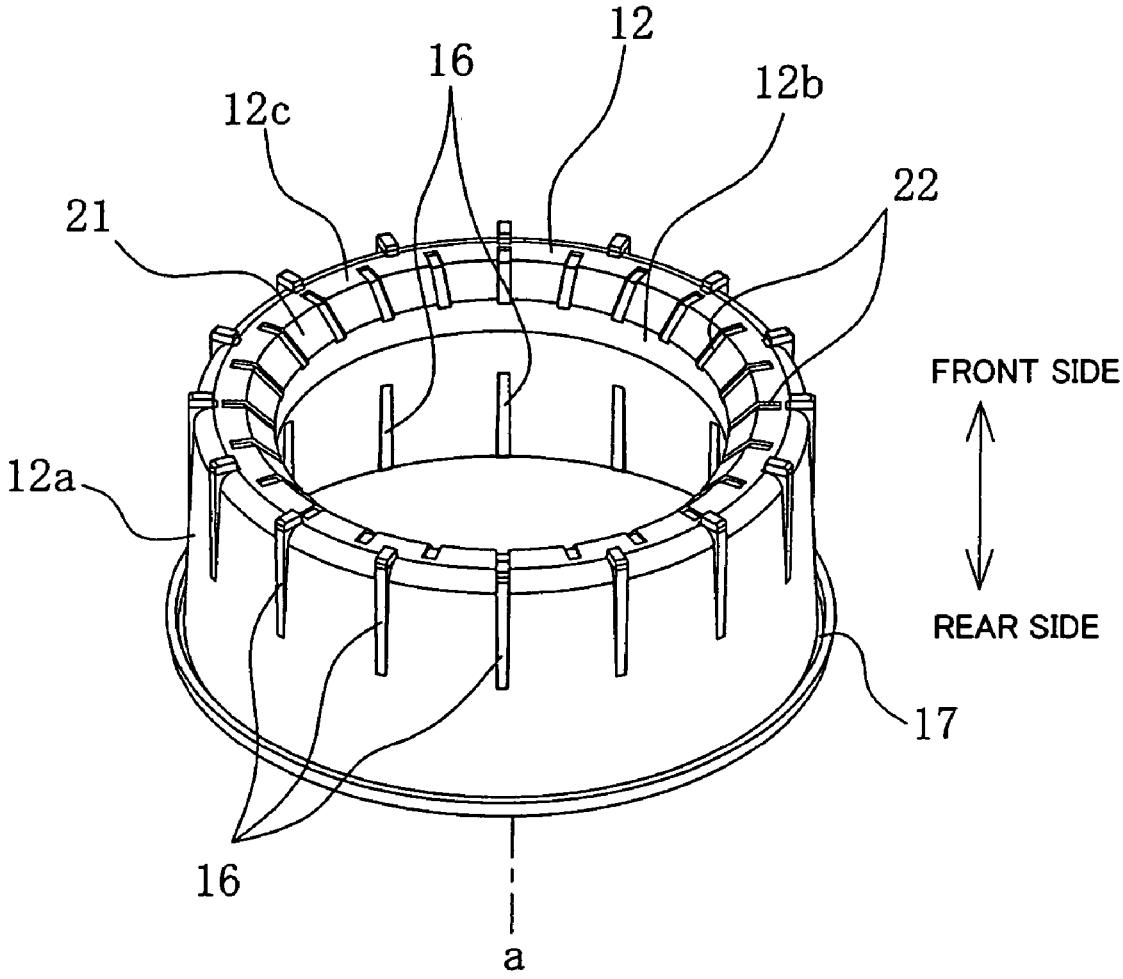
FIG. 5 is a perspective view of a connection member as shown in FIG. 1.

As shown in FIGS. 2 and 5, the connection member 12 is provided with a skirt portion 12*a* having a cylindrical shape, a downwardly extending wall 12*b* having a cylindrical shape and a top wall 12*c* having a ring-shape. The damper 9 and the cone are connected to the above-mentioned skirt portion 12*a*. The downwardly extending wall 12*b* is disposed on the inner side of the skirt portion 12*a* so that the voice coil bobbin 11 is connected to the downwardly extending wall 12*b*. The top wall 12*c* connects the upper edge of the skirt portion 12*a* to the upper edge of the downwardly extending wall 12*b*. The above-described ring-shared recess 15 is formed between the skirt portion 12*a* and the downwardly extending wall 12*b*.

The skirt portion 12*a* is preferably provided on its outer and inner surfaces with a plurality of ribs 16 at predetermined intervals, as shown in FIG. 5. The connection member 12 is preferably reinforced with these ribs 16 so as to support the damper 9 and the cone 10 in an appropriate manner.

The skirt portion 12*a* is provided, as shown in FIGS. 2 and 5, at the lower edge on the outer side, i.e., a position in which the second damping member 9*b* serving as the lower layer comes into contact with the skirt portion 12*a*, with an annular groove 17 having a U-shape so as to open toward the front side of the frame 1. The second damping member 9*b* is provided at its inner peripheral edge with a bent portion 18, which extends downwardly, i.e., toward the rear side of the frame 1. The above-mentioned bent portion 18 is received in the upwardly opening annular groove 17 of the skirt portion 12*a* so that the second damping member 9*b* is firmly connected to the connection member 12 through an adhesive (not shown) which is poured into the annular groove 17 and hardened.

An adhesive 19 is also poured into a space, which is formed by bringing the first damping member 9*a* serving as the upper layer and the cone 10 into contact with the skirt portion 12*a*, and then hardened as shown in FIG. 2. More specifically, the first damping member 9*a* is provided at its inner peripheral edge with a bent portion 20, which extends upwardly, i.e., toward the front side of the frame 1 so as to come into contact with the skirt portion 12*a*. The cone 10 is provided at its inner peripheral edge with a bent portion 10*a*, which extends downwardly, i.e., toward the rear side of the frame 1 so as to surround the inner peripheral edge of the first damping member 9*a*. The adhesive 19 is poured into an annular groove having a V-shape, which is defined by the above-mentioned bent portions 20, 10*a*, and the skirt portion 12*a*. Such a structure makes it possible to connect firmly the first damping member 9*a* and the cone 10 to the skirt portion 12*a*.

An inclined surface 21 is formed at a boundary region between the top wall 12*c* of the connection member 12 and the downwardly extending wall 12*b* thereof with which the voice coil bobbin 11 comes into contact, so as to extend toward the rear side of the frame 1. A plurality of slits 22 is formed radially so as to extend from the inclined surface 21 to the top wall 12*c*. An annular V-shaped groove is formed between the above-mentioned inclined surface 21 and the voice coil bobbin 11. An adhesive (not shown) is poured into the V-shaped groove and then hardened to bond the voice coil bobbin 11 to the connection member 12. The above-mentioned slits 22 formed in the inclined surface 21 enhance the bonding strength between the voice coil bobbin 11 and the connection member 12 through the adhesive. Alternatively, the above-mentioned slits 22 may be substituted by a plurality of fine projections, thus making it possible to enhance the bonding strength in the similar manner.

Now, operation of the loudspeaker having the above-described structure will be described below.

When assembling steps are carried out to manufacture the loudspeaker, the yoke 3 is inserted into the recess of the frame 1 in the direction of the arrow "b", and then turned in the direction of the arrow "c", as shown in FIG. 4. This causes the projection pieces 7 of the snap fastening device to be received in the grooves 8 of the snap fastening device from the respective openings 8*a* and then come into contact with the stoppers 8*b*. A smooth and accurate positional determination of the yoke 3 relative to the frame 1 can be made, and the yoke 3 can be held stationarily on the frame 1.

The yoke 3 and the other components such as the magnet 4 and the plate 5 are previously assembled into the magnetic circuit unit, as an occasion demands. Such a magnetic circuit unit is secured to the frame 1.

The damper 9 and the other components such as the cone 10, the voice coil bobbin 11 and the connection member 12 are also previously assembled into the vibration unit, as an occasion demands. Such a vibration unit is inserted into the recess of the frame 1 so as to surround the magnetic circuit unit, and then secured to the frame 1.

An assembling operation for the loudspeaker is completed by securing the magnetic circuit unit and the vibration unit to the frame 1.

Supply of electric signals to the voice coil 11*a* causes the voice coil bobbin 11 to vibrate in the central axis "a" of the frame 1 under the function of the magnetic path provided in the annular gap 6 of the yoke 3. Such vibration is propagated from the connection member 12 to the cone 10 so that the cone causes vibration in air.

The connection member 12 is reinforced with the plurality of ribs 16 formed on the inner and outer surfaces of the skirt portion 12*a*, thus making it possible to propagate the vibration of the voice coil bobbin 11 to the cone 10 in an appropriate manner, without causing deformation of the connection member 12.

The bent portion 18 of the second damping member 9*b* is received in the upwardly opening annular groove 17 of the skirt portion 12*a* and the adhesive is poured into such an annular groove 17 and then hardened. The adhesive 19 is poured into the annular groove, which is defined by the skirt portion 12*a*, the first damping member 9*a* and the cone 10, and then hardened. In addition, the slits 22 are formed on the inclined surface 21 of the connection member 12, in the vicinity of the downwardly extending wall 12*b* with which the voice coil bobbin 11 comes into contact, and the adhesive is poured into the V-shaped groove between the inclined surface 21 and the voice coil bobbin 11, and then hardened. It is therefore possible to enhance the bonding strength in the connected portions among the connection member 12, the voice coil bobbin 11, the cone 10 and the damper 9, thus preventing the connected portions from being peeled, even when considerable vibration occurs.

Second Embodiment

In the second embodiment of the present invention, the yoke 23 is inserted into the recess of the frame 24 from the rear side thereof in the different manner from the above-described first embodiment of the present invention.

The snap fastening device is composed of male members, which are provided on the bottom of the yoke 23, and female members, which are provided on the bottom of the recess of the frame 24.

Figure 6:
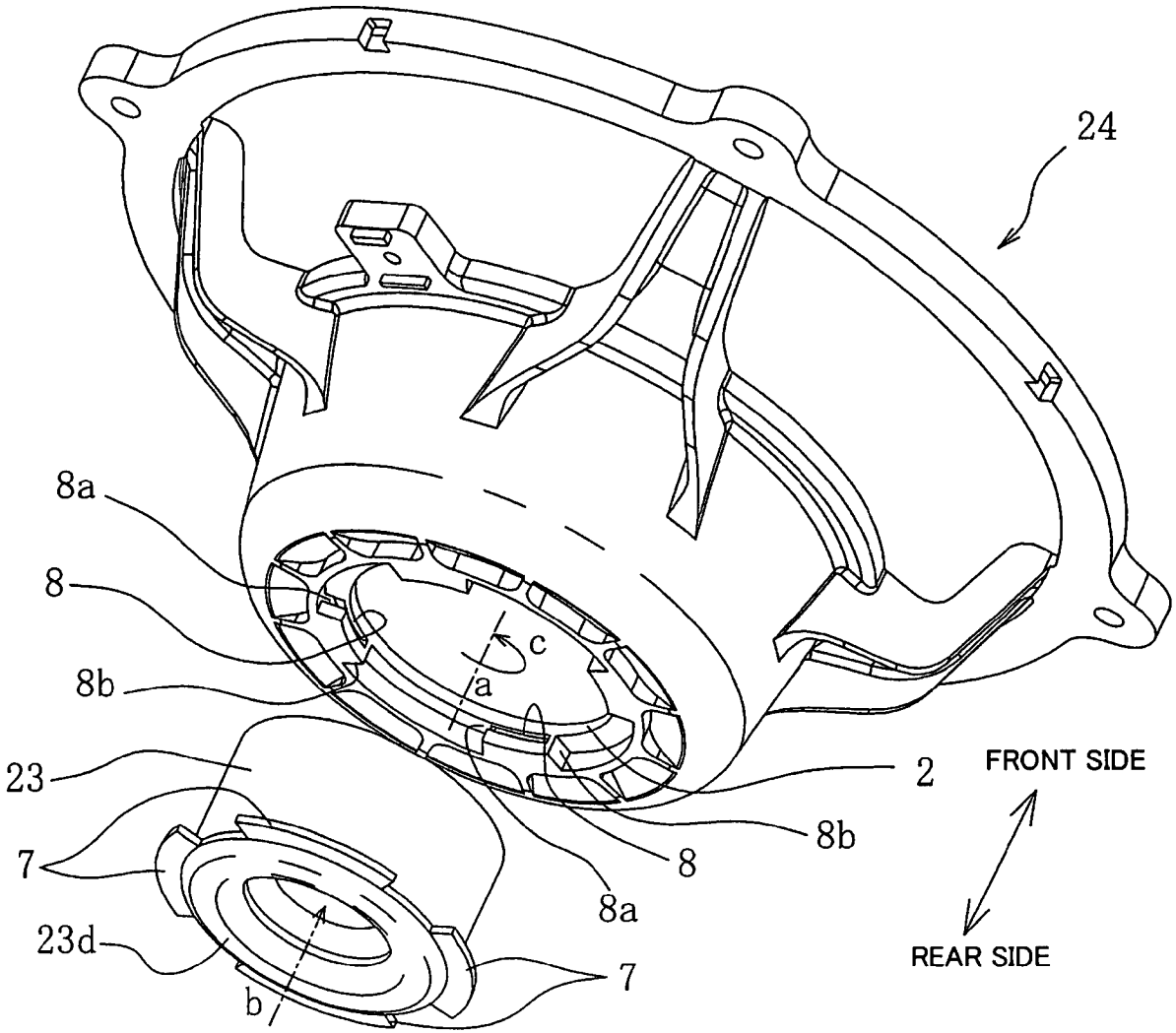
FIG. 6 is a perspective view of the loudspeaker according to the second embodiment of the present invention, illustrating the rear side of the loudspeaker.

As shown in FIG. 6, the male members are provided in the form of a plurality of projection pieces 7, which radially project from the outer periphery of the bottom plate 23*d* of the yoke 23 so as to be spaced uniformly, and the female members are provided in the form of grooves 8, which are formed on the inner periphery of the fitting hole 2 of the frame 24 so that the above-mentioned projection pieces 7 are fitted into the grooves 8. Each of the grooves 8 formed along the circle has an opening 8*a* on the upstream end side in a circumferential direction, on the one hand, and a stopper 8*b* is provided on the downstream side of each of the grooves 8 in the circumferential direction, on the other hand. According to such a structure, when the yoke 23 is inserted from its bottom side into the recess of the frame 24 in a direction of an arrow "b", and then, the yoke 23 is turned around the central axis "a" of the frame 24 in a direction of an arrow "c" so that the projection pieces 7 are inserted into the grooves 8, these projection pieces 7 come into the stoppers 8*b*, with the result the yoke 3 is kept in the properly secured state. Engagement of the male and female members is completed in this manner so as to make a proper positional determination of the yoke 23 relative to the frame 24 and hold it in such a state.

The invention may be embodied in other specific forms without departing from the spirit or essential characteristics thereof. The present embodiments are therefore to be considered in all respects as illustrative and not restrictive, the scope of the invention being indicated by the appended claims rather than by the fore going description and all changes which come within the meaning and range of equivalency of the claims are therefore intended to be embraced therein.

The entire disclosure of Japanese Patent Application No. 2003-102752 filed on Apr. 7, 2003 including the specification, claims, drawings and summary is incorporated herein by reference in its entirety.

What is claimed is:

1. A loudspeaker comprising:

a frame having a recess;

a magnetic circuit unit received in the recess of the frame, said magnetic circuit unit comprising a yoke;

a vibration unit received in the recess of the frame, said vibration unit comprising a damper, a cone, a voice coil bobbin and a connection member by which said damper, said cone and the voice coil bobbin are combined together, said connection member having on an outer side thereof an annular groove in which an inner peripheral edge of the damper is received, and the inner peripheral edge of the damper being secured in the annular groove; and a fastening device for connecting the yoke, which is inserted into the recess of the frame, to the frame.

2. The loudspeaker as claimed in claim 1, wherein:

said fastening device comprises male members and female members with which said male members are to be engaged, said male members being formed on any one of the frame and the yoke along a circle, which is concentric with a central axis thereof, and said female members being formed on an other of the frame and the yoke, said male members and said female members being engaged with each other by bringing the yoke into contact with the frame and turning the yoke along said circle.

3. The loudspeaker as claimed in claim 1, wherein:

said yoke has a cylindrical member; and said connection member having on an inner side thereof a ring-shaped recess into which said cylindrical member of the yoke is to be received.

4. The loudspeaker as claimed in claim 3, wherein:

said connection member has a skirt portion, which comes into contact with the damper and the cone, said skirt portion having a plurality of ribs.

5. The loudspeaker as claimed in claim 4, wherein:

said connection member is provided at its portion, which comes into contact with the voice coil bobbin, with an inclined surface, which extends toward a rear side of the frame, said inclined surface having a plurality of grooves.

6. The loudspeaker as claimed in claim 5, wherein:

said connection member is provided at its portion, which comes into contact with the damper, with a ring-shaped groove, which opens toward a front side of the frame.

7. The loudspeaker as claimed in claim 6, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

8. The loudspeaker as claimed in claim 5, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

9. The loudspeaker as claimed in claim 4, wherein:

said connection member is provided at its portion, which comes into contact with the damper, with a ring-shaped groove, which opens toward a front side of the frame.

10. The loudspeaker as claimed in claim 9, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

11. The loudspeaker as claimed in claim 4, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

12. The loudspeaker as claimed in claim 3, wherein:

said connection member is provided at its portion, which comes into contact with the voice coil bobbin, with an inclined surface, which extends toward a rear side of the frame, said inclined surface having a plurality of grooves.

13. The loudspeaker as claimed in claim 12, wherein:

said connection member is provided at its portion, which comes into contact with the damper, with a ring-shaped groove, which opens toward a front side of the frame.

14. The loudspeaker as claimed in claim 13, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

15. The loudspeaker as claimed in claim 12, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

16. The loudspeaker as claimed in claim 3, wherein:

said connection member is provided at its portion, which comes into contact with the damper, with a ring-shaped groove, which opens toward a front side of the frame.

17. The loudspeaker as claimed in claim 16, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

18. The loudspeaker as claimed in claim 3, wherein:

said damper has an inner peripheral edge coming into contact with the connection member, said inner peripheral edge having a bent portion, which projects toward the front side of the frame; and said cone has an inner peripheral edge, said inner peripheral edge of the cone having a bent portion, which projects toward the rear side of the frame, so as to surround the inner peripheral edge of the damper.

* * * * *